US011357345B2

(12) United States Patent
Moeller

(10) Patent No.: US 11,357,345 B2
(45) Date of Patent: Jun. 14, 2022

(54) HEIGHT ADJUSTABLE PILLOW

(71) Applicant: Elena Moeller, Pearland, TX (US)

(72) Inventor: Elena Moeller, Pearland, TX (US)

( * ) Notice: Subject to any disclaimer, the term of this patent is extended or adjusted under 35 U.S.C. 154(b) by 0 days.

(21) Appl. No.: 15/616,828

(22) Filed: Jun. 7, 2017

(65) Prior Publication Data

US 2017/0347815 A1 Dec. 7, 2017

Related U.S. Application Data

(60) Provisional application No. 62/346,770, filed on Jun. 7, 2016.

(51) Int. Cl.

*A47G 9/02* (2006.01)
*A47G 9/10* (2006.01)
*A47G 9/00* (2006.01)

(52) U.S. Cl.

CPC ..... *A47G 9/0253* (2013.01); *A47G 9/10* (2013.01); *A47G 9/1054* (2013.01); *A47G 9/1072* (2013.01); *A47G 2009/001* (2013.01); *A47G 2009/1018* (2013.01)

(58) Field of Classification Search

CPC ..... A47G 9/0253; A47G 9/04; A47G 9/10; A47G 2009/001; A47G 9/1054; A47G 9/1072; A47G 2009/1018

See application file for complete search history.

(56) References Cited

U.S. PATENT DOCUMENTS 754,329 A * 3/1904 Milliken ..... A47C 27/001 5/722
D126,825 S * 4/1941 Kolisch ..... D6/601
2,248,768 A * 7/1941 Licht ..... A47G 9/0207 5/485
2,589,303 A * 3/1952 Sourbeck ..... A47G 9/10 5/645
4,393,520 A * 7/1983 Koch ..... A41D 13/08 2/16
4,514,869 A * 5/1985 Aoki ..... B60N 2/5825 156/245
D316,001 S * 4/1991 Guard ..... D6/601
5,023,970 A * 6/1991 Tesch ..... A47G 9/0207 5/482
5,038,432 A * 8/1991 Robillard ..... A47G 9/10 5/645
5,088,141 A * 2/1992 Meyer ..... A47G 9/10 5/636
5,187,825 A * 2/1993 Tesch ..... A47G 9/0207 5/482
5,363,524 A * 11/1994 Lang ..... A47G 9/10 5/640
5,483,713 A * 1/1996 Kikuchi ..... A41D 27/245 112/440

(Continued)

*Primary Examiner* — Peter M. Cuomo
*Assistant Examiner* — Morgan J McClure
(74) *Attorney, Agent, or Firm* — Bruce A. Lev

(57) ABSTRACT

A height adjustable pillow is a hypoallergenic pillow having a closable pillow case and preferably five cushions within that may be added or removed one at a time to adjust the height of the pillow. The top cushion is stitched diagonally corner to corner to make it easier to place an infant on the pillow so that the infant's head is able to rest comfortably in a chosen position without rolling to a less comfortable position.

13 Claims, 3 Drawing Sheets

(56) References Cited

U.S. PATENT DOCUMENTS 5,522,105 A * 6/1996 Fujiwara ..... A47C 31/005 128/202.18
D373,477 S * 9/1996 Lewis ..... D6/349
5,708,998 A * 1/1998 Torbik ..... A47G 9/10 5/636
5,953,777 A * 9/1999 Buck ..... A47G 9/10 5/490
D416,160 S * 11/1999 Garcia, Sr. ..... D6/595
5,987,669 A * 11/1999 Leggett ..... A41D 31/0038 112/420
5,987,676 A * 11/1999 Littleford ..... A47G 9/10 5/636
6,076,214 A * 6/2000 Klimenko ..... A47C 27/081 5/706
6,910,237 B2 * 6/2005 DiGirolamo ..... A47G 9/0253 5/490
7,045,191 B2 * 5/2006 Huntley ..... A41D 31/0038 112/420
D523,678 S * 6/2006 Ferber ..... A47G 9/0253 D6/601
7,080,421 B1 * 7/2006 Delfs ..... A47G 9/0207 5/502
7,152,263 B1 * 12/2006 Delfs ..... A47G 9/10 5/636
D613,105 S * 4/2010 Chuang ..... D6/601
7,735,169 B2 * 6/2010 Wassilefsky ..... A47G 9/10 5/490
7,832,034 B2 * 11/2010 Liu ..... A47G 9/10 5/490
D645,691 S * 9/2011 Heroux ..... D6/601
D675,855 S * 2/2013 Reeves ..... D6/601
8,448,273 B2 * 5/2013 Walker ..... A47G 9/10 5/413 R
8,555,429 B2 * 10/2013 Leach ..... A47K 3/127 4/572.1
D699,483 S * 2/2014 Berg ..... D6/601
D702,060 S * 4/2014 Harris ..... D6/601
D717,503 S * 11/2014 Diskin ..... D30/118
8,931,127 B1 * 1/2015 Moses ..... A47C 27/142 2/65
D724,351 S * 3/2015 Harris ..... D6/601
D737,074 S * 8/2015 Sobran ..... D6/601
D740,053 S * 10/2015 Sobran ..... D6/601
9,247,836 B2 * 2/2016 DuPre ..... A47G 9/1045
D759,402 S * 6/2016 Thomas ..... D6/601
9,427,087 B2 * 8/2016 Clarke ..... A47C 7/383
D779,856 S * 2/2017 Rich ..... D6/601
9,775,440 B1 * 10/2017 Chon ..... A47C 20/021
2003/0233706 A1 * 12/2003 Birch ..... A47G 9/0207 5/502
2009/0199341 A1 * 8/2009 Schantz ..... A47G 9/10 5/645
2011/0239369 A1 * 10/2011 Dobin ..... A47G 9/0207 5/502
2012/0073056 A1 * 3/2012 Freund ..... A47G 9/0253 5/639
2012/0186015 A1 * 7/2012 Shattuck ..... A47G 9/0223 5/485
2013/0111671 A1 * 5/2013 Smithson ..... A47C 27/122 5/690
2015/0135435 A1 * 5/2015 Ueda ..... A47G 9/0207 5/502
2016/0073790 A1 * 3/2016 Goenka ..... A47C 31/105 5/691
2019/0008293 A1 * 1/2019 Bergman ..... A47G 9/0253

* cited by examiner

HEIGHT ADJUSTABLE PILLOW

CROSS-REFERENCE TO RELATED APPLICATION

The present application is related to and claims priority from prior provisional application Ser. No. 62/346,770, filed Jun. 7, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of pillows and more specifically relates to a height adjustable pillow.

2. Description of the Related Art

A pillow is used to sleep on and support the head/neck or other parts of the body while sleeping, lying down or sitting. In addition, pillows have decorative uses and are used on beds, couches or chairs; these are also referred to as cushions. In contemporary western culture pillows consist of a fabric envelope which contains a soft stuffing, which may range from down feathers to synthetic foam. In other cultures, pillows have been made of wood or stone.

A favorite pastime of most people is to stack pillows and recline in a comfortable position to watch television. Many individuals with certain health disorders sleep best in a steeply inclined position because breathing is a little easier in this position. It usually takes trial and error and a little bit of time to find the exact combination of pillows for each individual to find their optimum comfort level since many pillows varies in size and shape. When sleeping, some people develop sore neck and or shoulder muscles, and even develop back or neck problems because of improper neck alignment. The height of the pillow will determine neck alignment. Pillows for sleeping are generally manufactured in standard or extra large sizes because it is assumed that since a pillow can be reshaped and compressed, other sizes are not necessary. Proper neck alignment, however, requires better accuracy especially when joint problems exist. Children of different ages, and especially small children, generally get whatever is available which is seldom of a height suitable for them. A solution to these problems are needed.

Various attempts have been made to solve the above-mentioned problems such as those found in U.S. Pat. No. 5,953,777 to Ronald Mark Buck; U.S. Publication No. 2013/0263377 to Gerald E. Wootten, Jr.; and U.S. Publication No. 2012/0073056 to William Freund. This art is representative of adjustable pillows. None of the above inventions and patents, taken either singly or in combination, is seen to describe the invention as claimed.

Ideally, an adjustable pillow should provide height adjustment in increments, and yet, would operate reliably and be manufactured at a modest expense. Thus, a need exists for a reliable height adjustable pillow to avoid the above-mentioned problems.

BRIEF SUMMARY OF THE INVENTION

In view of the foregoing disadvantages inherent in the known pillow art, the present invention provides a novel height adjustable pillow. The general purpose of the present invention, which will be described subsequently in greater detail, is to provide height adjustment in increments.

The height adjustable pillow preferably comprises a pillow case having an outer layer that includes a top surface and a bottom surface attached together at three edges to form an interior volume, a plurality of pillow cushions each that include an outer layer having a top surface and a bottom surface forming an interior volume, and a cushion material placed within the interior volume.

The top surface is stitched to the bottom surface in a predetermined pattern in order to keep the cushion material in place within the interior volume, and each of the pillow cushions are formed having substantially the same dimensions and are adapted to be placed within the interior volume of the pillow case such that a user can add or remove one pillow cushion at a time within the interior volume of the pillow case in order to progressively increase or decrease the overall height of the height adjustable pillow.

Each of the pillow cushions is formed having a height of approximately 1 inch and there may be approximately five pillow cushions altogether. Each of the pillow cushions are formed having a rectangular shape, and one of the pillow cushions is stitched from corner-to-corner of the rectangular shape forming four triangular shapes. Four of the pillow cushions are stitched from edge-to-edge of the rectangular shape forming four substantially equally dimensioned rectangular shapes such that the one of the pillow cushions having four triangular shapes can be inserted within the pillow case first solely for holding a baby's head in a desire position. Each of the pillow cushions is formed having a rectangular shape and one of the pillow cushions is stitched from corner-to-corner forming four triangular shapes, and the remaining pillow cushions are stitched from edge-to-edge forming four substantially equally dimensioned rectangular shapes such that the pillow cushions having four triangular shapes can be inserted within the pillow case first solely to be used for holding a baby's head in a desire position.

The pillow case further includes a releasable fastener member attached between the top surface and a bottom surface and releasably encloses the interior volume to hold the pillow cushions within. The releasable fastener member may be formed as a zipper member but may instead be formed as hook and loop material in some embodiments. The pillow case, the cushion material, and the outer layers of the pillow cushions are all preferably formed from non-allergenic material and the pillow case may be formed from cotton, silk, or from some other suitable fabric. The cushion material and the outer layers of the pillow cushions may be formed from cotton.

The present invention holds significant improvements and serves as a height adjustable pillow. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, height adjustable pillow, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a pillow and more particularly to a height adjustable pillow as used to provide height adjustment in increments.

Generally speaking, a height adjustable pillow is a hypoallergenic pillow having a closable pillow case and preferably five cushions within that may be added or removed one at a time to adjust the height of the pillow. The top cushion is stitched diagonally corner to corner to make it easier to place an infant on the pillow so that the infant's head is able to rest comfortably in a chosen position without rolling to a less comfortable position.

Figure 1:
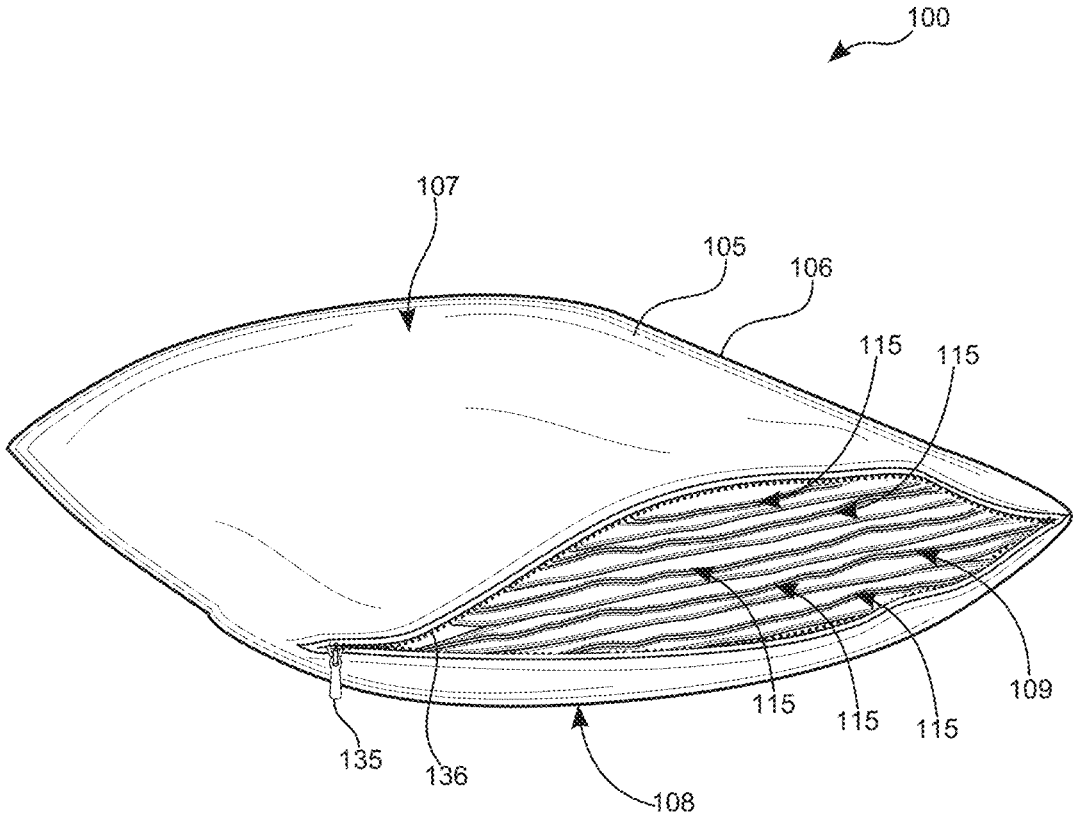
FIG. 1 shows a perspective view illustrating a height adjustable pillow according to an embodiment of the present invention.

In greater detail now, referring to the drawings by numerals of reference there is shown in FIG. 1, a perspective view illustrating a height adjustable pillow according to an embodiment of the present invention.

The height adjustable pillow preferably comprises a pillow case having an outer layer that includes a top surface and a bottom surface attached together at three edges to form an interior volume, a plurality of pillow cushions each that include an outer layer having a top surface and a bottom surface forming an interior volume, and a cushion material placed within the interior volume.

The top surface is stitched to the bottom surface in a predetermined pattern in order to keep the cushion material in place within the interior volume, and each of the pillow cushions are formed having substantially the same dimensions and are adapted to be placed within the interior volume of the pillow case such that a user can add or remove one pillow cushion at a time within the interior volume of the pillow case in order to progressively increase or decrease the overall height of the height adjustable pillow.

Figure 2:
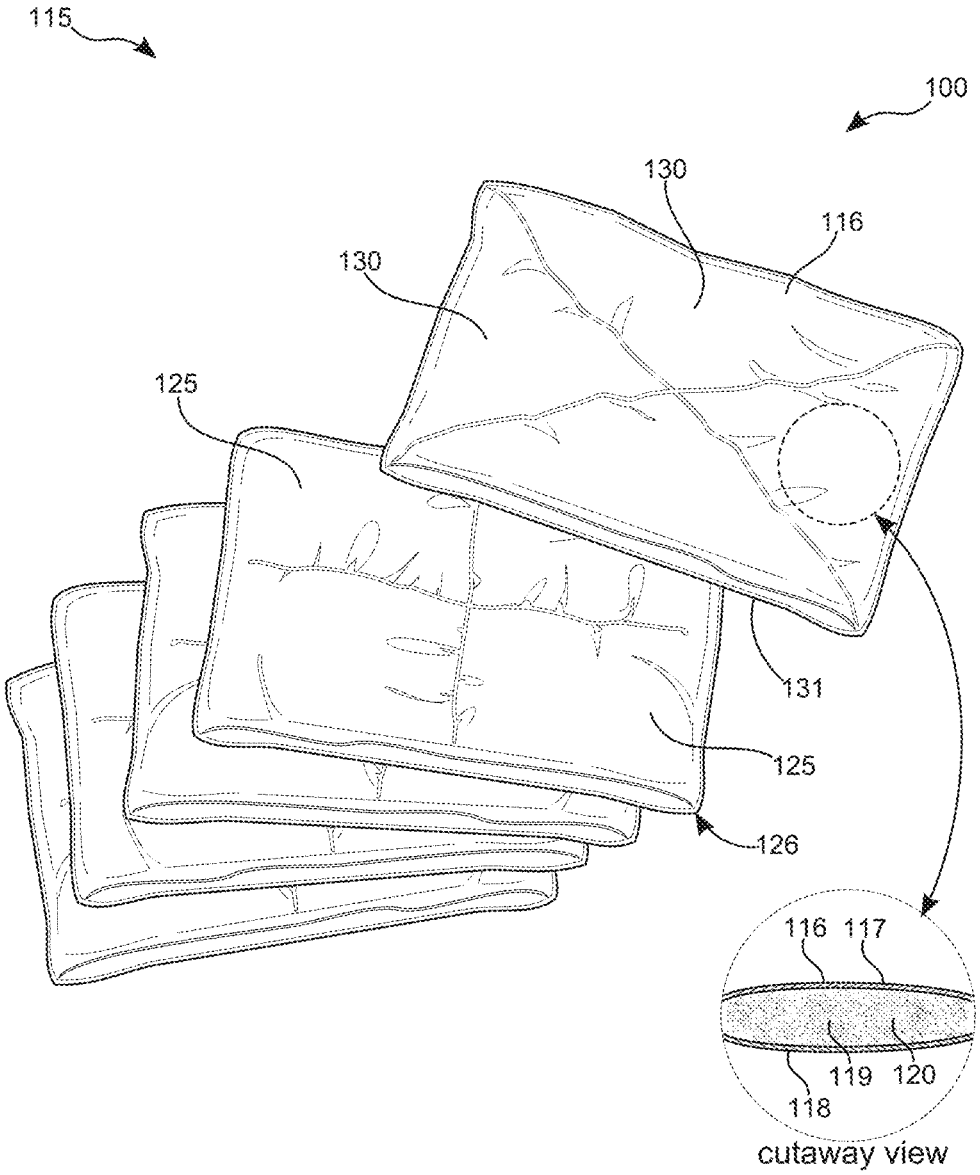
FIG. 2 is a perspective view illustrating a height adjustable pillow according to an embodiment of the present invention of FIG. 1.

Referring now to FIG. 2, a perspective view illustrating a height adjustable pillow according to an embodiment of the present invention of FIG. 1.

Each of the pillow cushions is formed having a height of approximately 1 inch and there may be approximately five pillow cushions altogether. Each of the pillow cushions are formed having a rectangular shape, and one of the pillow cushions is stitched from corner-to-corner of the rectangular shape forming four triangular shapes. Four of the pillow cushions are stitched from edge-to-edge of the rectangular shape forming four substantially equally dimensioned rectangular shapes such that the one of the pillow cushions having four triangular shapes can be inserted within the pillow case first solely for holding a baby's head in a desire position. Each of the pillow cushions is formed having a rectangular shape and one of the pillow cushions is stitched from corner-to-corner forming four triangular shapes, and the remaining pillow cushions are stitched from edge-to-edge forming four substantially equally dimensioned rectangular shapes such that the pillow cushions having four triangular shapes can be inserted within the pillow case first solely to be used for holding a baby's head in a desire position.

Figure 3:
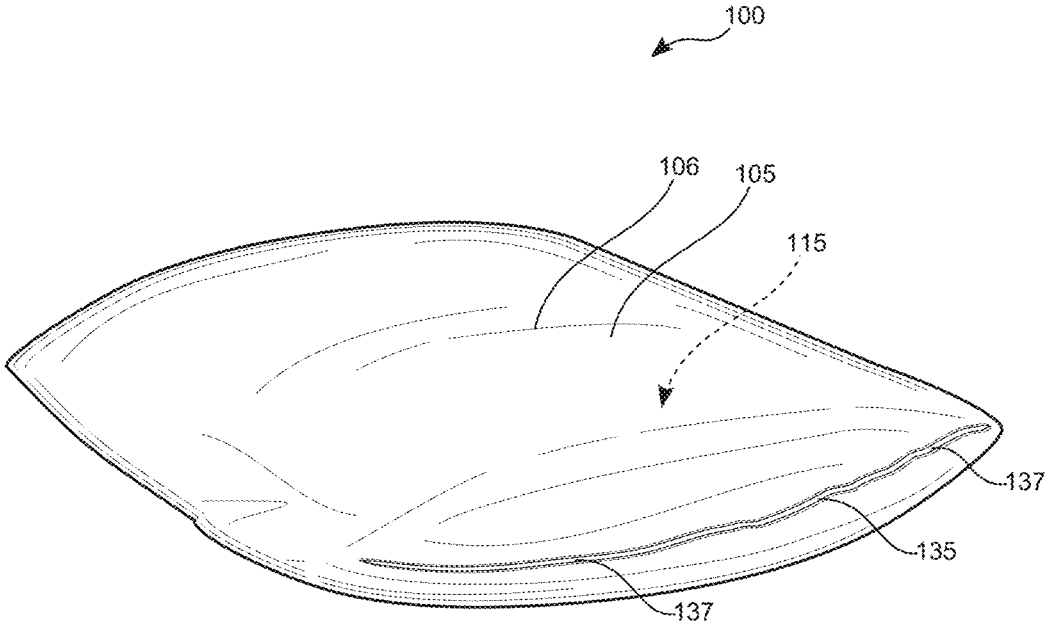
FIG. 3 is a perspective view illustrating height adjustable pillow according to an embodiment of the present invention of FIG. 1.

Referring now to FIG. 3, a perspective view illustrating height adjustable pillow according to an embodiment of the present invention of FIG. 1.

The pillow case further includes a releasable fastener member attached between the top surface and a bottom surface and releasably encloses the interior volume to hold the pillow cushions within. The releasable fastener member may be formed as a zipper member but may instead be formed as hook and loop material in some embodiments. The pillow case, the cushion material, and the outer layers of the pillow cushions are all preferably formed from non-allergenic material and the pillow case may be formed from cotton, silk, or from some other suitable fabric. The cushion material and the outer layers of the pillow cushions may be formed from cotton.

Height adjustable pillow 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A height adjustable pillow comprising:

a pillow case including:

an outer layer;

wherein said outer layer includes a top surface and a bottom surface, and forms an interior volume;

a plurality of pillow cushions, each including:

an outer layer;

wherein said outer layer includes a top surface and a bottom surface, and forms an interior volume;

a cushion material placed within said interior volume;

wherein said top surface is stitched to said bottom surface in a predetermined pattern in order to keep said cushion material in place within said interior volume;

wherein each of said plurality of pillow cushions are formed having substantially the same dimensions, and are adapted to be placed within said interior volume of said pillow case, such that a user can add or remove one pillow cushion at a time within said interior volume of said pillow case in order to progressively increase or decrease an overall height of said height adjustable pillow;

wherein each of said plurality of pillow cushions is formed having a rectangular shape;

wherein one of said plurality of pillow cushions is stitched from corner-to-corner of said rectangular shape forming four triangular shapes on said top surface and said bottom surface; and wherein the other of said plurality of pillow cushions are stitched from edge-to-edge of said rectangular shape forming four substantially equally dimensioned rectangular shapes on said top surface and said bottom surface; and wherein said one of said plurality of pillow cushions having four triangular shapes is inserted within said pillow case adjacent to said outer layer of said pillow case, and is adapted to create friction with respect to said four rectangular shapes of an adjacent one of said other plurality of pillow cushions and to said outer layer of said pillow case, to thereby resist movement therebetween, and thereby be adapted to hold a baby's head in a desired and secure position.

2. The height adjustable pillow of claim 1, wherein each of said plurality of pillow cushions are formed having a height of 1 inch.

3. The height adjustable pillow of claim 2, wherein there are five of said plurality of pillow cushions.

4. The height adjustable pillow of claim 1, wherein said pillow case further includes a releasable fastener member attached between said top surface and a bottom surface and releasably encloses said interior volume to hold said plurality of pillow cushions therein.

5. The height adjustable pillow of claim 4, wherein said releasable fastener member is formed as a zipper member.

6. The height adjustable pillow of claim 4, wherein said releasable fastener member is formed as a hook and loop material.

7. The height adjustable pillow of claim 1, wherein said pillow case is formed from a non-allergic material.

8. The height adjustable pillow of claim 1, wherein said pillow case is formed from cotton.

9. The height adjustable pillow of claim 1, wherein said pillow case is formed from silk.

10. The height adjustable pillow of claim 1, wherein said cushion material is formed from a non-allergic material.

11. The height adjustable pillow of claim 1, wherein said cushion material is formed from cotton.

12. The height adjustable pillow of claim 1, wherein said outer layers of said plurality of pillow cushions are formed from a non-allergic material.

13. The height adjustable pillow of claim 1, wherein said outer layers of said plurality of pillow cushions are formed from cotton.

* * * * *